US006533015B1

(12) United States Patent
Moore

(10) Patent No.: US 6,533,015 B1
(45) Date of Patent: Mar. 18, 2003

(54) APPARATUS FOR APPLYING LABELS TO CONTAINERS

(76) Inventor: Marc Moore, P.O. Box 91510, Albuquerque, NM (US) 87109

( * ) Notice: Subject to any disclaimer, the term of this patent is extended or adjusted under 35 U.S.C. 154(b) by 124 days.

(21) Appl. No.: 09/823,806

(22) Filed: Mar. 30, 2001

(51) Int. Cl.[7] ..... B65C 3/10; B65C 3/12

(52) U.S. Cl. ..... 156/540; 156/542; 156/556; 156/DIG. 10; 156/DIG. 11

(58) Field of Search ..... 156/540, 541, 156/542, 579, DIG. 24, DIG. 28, DIG. 33, DIG. 37, DIG. 39, DIG. 40, DIG. 3, DIG. 5, DIG. 10, DIG. 11, 556

(56) References Cited

U.S. PATENT DOCUMENTS 3,278,359 A * 10/1966 Wesley ..... 118/245
4,129,473 A * 12/1978 Perret ..... 156/361
4,601,771 A * 7/1986 Wesley ..... 156/215
4,758,303 A * 7/1988 Shastko ..... 156/542
5,167,749 A * 12/1992 Kasak ..... 156/446
5,674,350 A * 10/1997 Jurgich ..... 156/540

* cited by examiner

*Primary Examiner*—Richard Crispino
*Assistant Examiner*—Sue A. Purvis
(74) *Attorney, Agent, or Firm*—Rod D. Baker; Peacock, Myers & Adams, P.C.

(57) ABSTRACT

An apparatus and method for applying pressure-sensitive adhesive labels to articles, especially containers such as bottles, jars and cans. A pair of rollers define a cradle in which an article to be labeled rests. The rollers are adjustably mounted in a frame which also has a feeder reel thereon from which a roll of labels are paid out on a strip of substrate. The label-bearing substrate strip is wrapped around an edge of a plate mounted on the frame. Waste substrate is pinched between one of the cradle rollers and the article and then re-wound back to the roll on the feeder reel, so that the manual rolling of the article in the cradle pulls the label-bearing substrate from the roll to the edge of the plate. At the point where the substrate wraps around the edge of the plate, the label detaches from the substrate and is applied to the article. This action is repeated to serially apply labels to many articles. The apparatus is adjustable to accommodate a wide variety of article and container types and sizes.

20 Claims, 6 Drawing Sheets

APPARATUS FOR APPLYING LABELS TO CONTAINERS

BACKGROUND OF THE INVENTION

1. Field of the Invention (Technical Field)

The present invention relates generally to apparatuses for applying labels to articles, and specifically relates to an apparatus for rapidly manually applying adhesive labels to cylindrical objects such as glass or plastic bottles or metal cans.

2. Background Art

Generally, devices for applying labels to articles are highly automated, electrically or pneumatically powered, expensive, and sometimes potentially hazardous to the operator. Large, powerful, label applicator devices are commonly used in high-volume industries that package products, such as foodstuffs and other consumer goods, in containers such as cans and bottles. These large automated devices are expensive to purchase and operate, and thus commonly are encountered only in large mass production facilities.

A need remains for a label applicator device that is practical for use by small businesses. Such a label applicator apparatus should be simple, affordable, and inexpensively manufactured. Also, such an applicator apparatus should pose no potential physical danger to the operator, who may be a user in a home-based business. Thus a simple, manually powered applicator appealing to small business may process articles would fulfill an unmet need among small businesses who must efficiently apply labels to many articles, such as containers—even though the number of articles may be modest compared to high-volume mass production facilities.

SUMMARY OF THE INVENTION (DISCLOSURE OF THE INVENTION)

Broadly characterized, the invention is an apparatus and method for applying pressure-sensitive adhesive labels to articles, especially containers such as bottles, jars and cans. A pair of rollers define a cradle in which an article to be labeled rests. The rollers are adjustably mounted in a frame which also has a feeder reel thereon from which a roll of labels are paid out on a strip of substrate. The label-bearing substrate strip is wrapped around an edge of a plate mounted on the frame. Waste substrate is pinched between one of the cradle rollers and the article and then re-wound back to the roll on the feeder reel, so that the manual rolling of the article in the cradle pulls the label-bearing substrate from the roll to the edge of the plate. At the point where the substrate wraps around the edge of the plate, the label detaches from the substrate and is applied to the article. This action is repeated to serially apply labels to many articles. The apparatus is adjustable to accommodate a wide variety of article and container types and sizes.

There is provided according to the invention an apparatus for dispensing a label from a roll of label-bearing substrate and for applying the label to an article, said apparatus comprising a frame comprising separated side panels, a feed reel mounted between said side panels and upon which the roll may be removably disposed, a label detachment roller, mounted between said side panels, for partially supporting the article, and a separator plate disposed between said side panels and having a front edge generally parallel and proximate to said detachment roller; wherein substrate paid out from the spool is wrappable around said front edge thereby to induce detachment of the label from the substrate and application of the label to the article supported in part by the detachment roller. Some means for adjusting the distance between said side panels is provided, such as a threaded rod screwably engaged with said side panels.

The apparatus preferably includes a pair of collars upon said feed reel for containing the label roll, said collars selectively positionable axially along said feed reel to position the label in relation to the article. The feed reel is removably disposable upon said side panels, said side panels defining slots for receiving a shaft of said feed reel. The apparatus features a brake assembly for selectively controlling the rotation of said feed roller; the brake assembly preferably comprises a brake arm pivotally mounted to one of said side panels, a brake spring for biasing said arm into frictional contact with said feed roller, and a brake adjustment screw for adjusting the bias force of said brake spring.

The apparatus' separator plate is selectively movable to adjust the distance between said front edge and said detachment roller to optimize detachment of the label and application of the label to the article.

Also included in the apparatus is a seating roller mounted between said side panels forward on said frame from, and parallel to, said label detachment roller, for partially supporting the article, wherein rotation of the article induces simultaneous rotary motion in said detachment roller and said seating roller. The side frame panels define a plurality of opposing slots for selectively receiving a shaft on said seating roller, wherein the distance of said seating roller from said detachment roller is adjustable. There preferably is at least one end ring disposed upon said seating roller, to help hold the article against axial shifting during the application of a label. Thus, the least one end ring is selectively movable axially along said seating roller to position said at least on end ring adjacent to an end of the article.

A friction sleeve, such as from fabric (e.g. a hook-and-loop fabric) preferably is disposed upon said label detachment roller.

The side panels preferably define at least a pair of slots for removably receiving a shaft on said label detachment roller, and at least one guide roller preferably is disposed between said side panels. At least one guide ring is movable axially upon said at least one guide roller, for guiding movement of the substrate.

Application of the label leaves remaining a waste substrate, and the waste substrate is rewound upon said feed reel.

A primary object of the present invention is to provide an apparatus for applying labels to articles that is suitable for use in small businesses, cottage industries, and by individual entrepreneurs.

A primary advantage of the present invention is that the apparatus is inexpensive to manufacture and maintain.

Another advantage of the present invention is that the a preferred embodiment of the apparatus requires no electrical or pneumatic power to operate.

The apparatus of the invention permits labels to be applied rapidly (e.g. up to around 30–35per minute).

Another advantage of the invention is that the apparatus is easily adjustable to accommodate articles and containers of different sizes and shapes.

Another advantage of the invention is that the apparatus permits quick and easy changing of the labels to be dispensed.

The apparatus of the invention consistently places labels straight and in the proper position.

The apparatus is reliable, and offers the advantage of very seldom breaking down (and thus stopping production).

Another advantage of the invention is that it is quiet.

Another advantage of the invention is that the apparatus is very safe to operate.

Another advantage of the invention is that the apparatus is portable.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
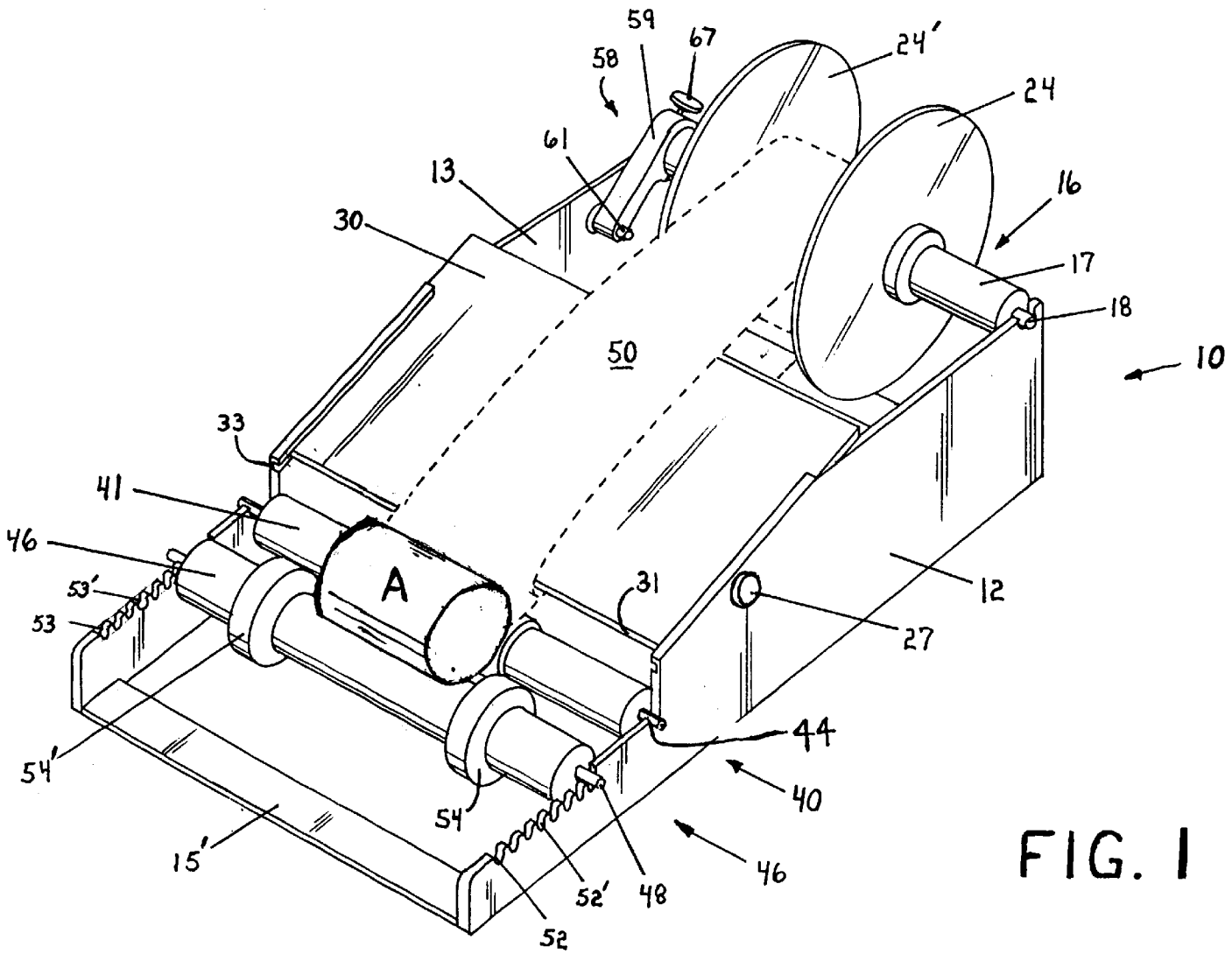
FIG. 1 is a perspective view, from above, of a preferred embodiment of the apparatus of the invention.

DESCRIPTION OF THE PREFERRED EMBODIMENTS (BEST MODES FOR CARRYING OUT THE INVENTION)

The present invention is a simple, inexpensively manufactured, easy to operate labeling apparatus. The apparatus is well-suited for use in small businesses, where the need quickly to apply adhesive labels to many articles suggests the need for a mechanical assist to the process, but where the total processing volume is too small to justify large and expensive electrically- or pneumatically-driven automated labeling machines. The present invention is simple and safe to use, thus also presenting advantages for the individual entrepreneur or small business. Nevertheless, the advantages of the invention may be realized in any circumstance where it is desired to apply labels to numerous articles quickly and efficiently. The present invention in its simplest preferred embodiment is manually powered by the operator; no source of electrical, pneumatic, or hydraulic power is necessary. Nevertheless, it will be apparent to one of ordinary skill that the apparatus could be supplied with a source of auxiliary power, and thus be a powered apparatus.

The labels to be applied are provided upon a strip of conventional liner or substrate, such as a siloxane polymer-coated paper, or wax paper, wound around itself into a roll, or perhaps on a cardboard or plastic spool or core. The roll of label-bearing substrate thus is separately provided for use in the inventive apparatus. The apparatus will function to apply die-cut or butt-cut labels, and the labels may be either left edge leading or right edge leading. The labels are removably adhered to the long strip of substrate, which substrate may then be unwound from the roll. For example, the adhesive label to be applied is preprinted in bulk and releasably applied in a uniform series upon a long strip of coated paper substrate, which is then wound into an ordinary roll. The substrate may be simply be wound around itself, or may be wrapped around a disposable spool; the invention can accommodate either spooled or non-spooled labels with equal convenience.

The coating on the paper permits only a comparatively weak adhesion of the labels to the substrate, so that the labels are readily peeled from the substrate. After removal from the substrate, the labels are applicable to articles, such as containers, for example plastic or glass bottles, or metal cans. The adhesive on the underside of the labels affixes the labels securely to the exterior of the article to be labeled. Labels releasably adhered to substrate and wound upon small spools are common and known in the art; the inventive apparatus is for the manipulation of such conventional rolls of adhesive labels. In sum, the invention is adapted conveniently and quickly to perform the steps of removing a label from the strip of substrate and applying the label to a article, and to perform these steps repeatedly in a series to assist in the labeling of numerous articles.

An advantage of the apparatus is its versatility. A typical embodiment accommodates label strip or "web" width of up to about 10 cm, and label rolls of up to around 30 cm.

A wide variety of articles may be labeled by the apparatus of the invention, but the invention is best suited for labeling bottles, cans and other containers. The articles should be generally cylindrical in shape. The inventive apparatus may be constructed in virtually any size, with larger sizes of the apparatus able to process larger articles; likewise, a comparatively smaller version of the apparatus could be fashioned to permit the labeling of very small items such as toy articles or small pill bottles. However, the most versatile and universally useable embodiment of the apparatus may feature, by way of example, overall dimensions of about 60 cm inches in length, about 25 cm to 30 cm in width, and about 20 cm to 25 cm in height. An embodiment of such dimensions permits the labeling of articles from, for example, about 3 or 4 cm in diameter to about 12 to 15 cm in diameter, and, for example from about 2.0 cm to about 24.0 cm in height. These dimensions are by way of typical example, and the dimensions of the apparatus particularly may be increased to accommodate articles of relatively larger size.

It is seen, therefore, that the apparatus will accommodate nearly any round article, including containers (full or empty) such as glass or plastic jars or bottles, including, for example wine magnums. Further, as shall be further explained, the apparatus will apply labels to articles having a recessed or indented label area up to about 1.5 cm deep. With minor adaption, the apparatus may be employed to apply labels to small rectangular boxes.

Figure 2:
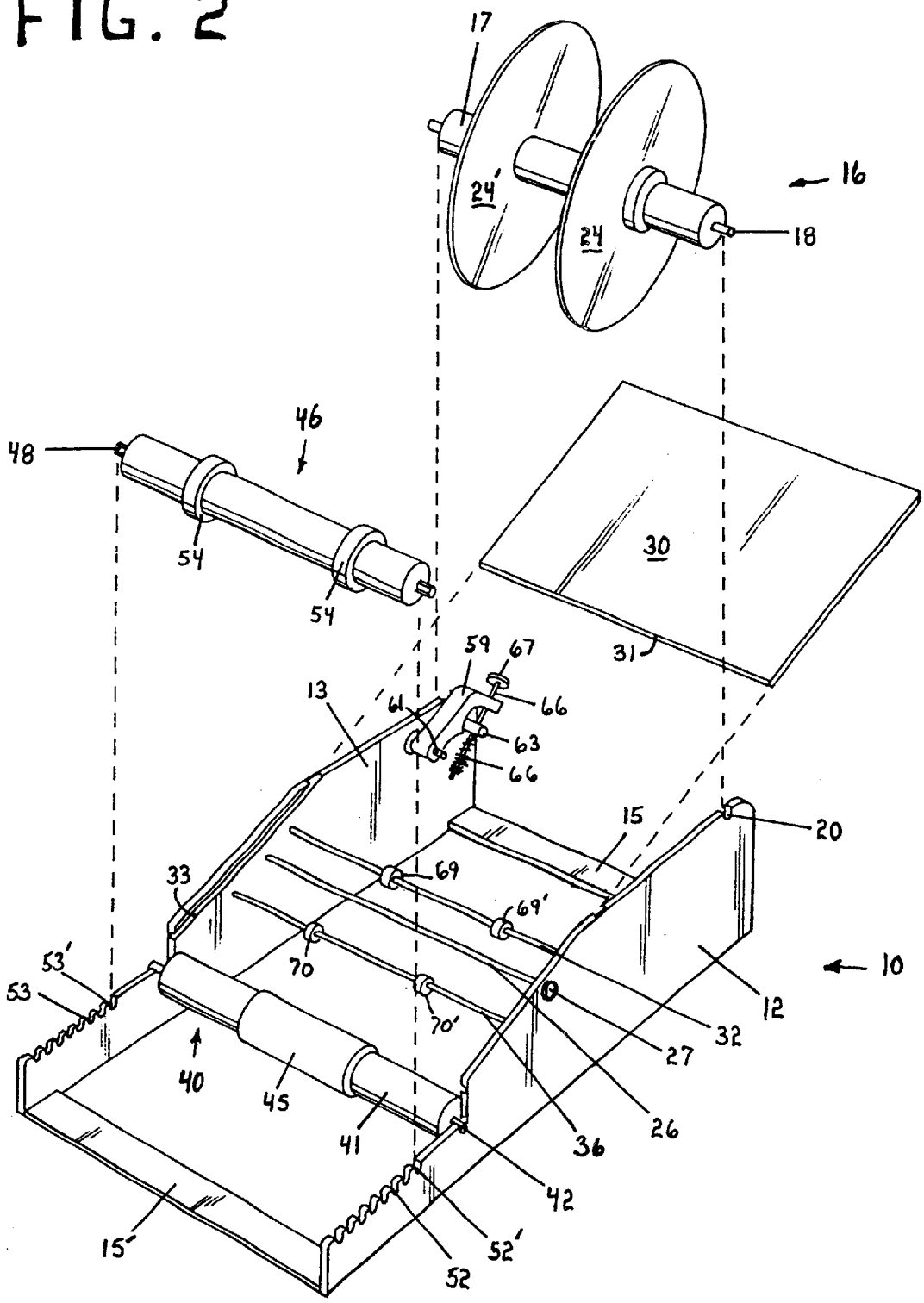
FIG. 2 is an exploded view of the embodiment of the invention depicted in FIG. 1.
Figure 3:
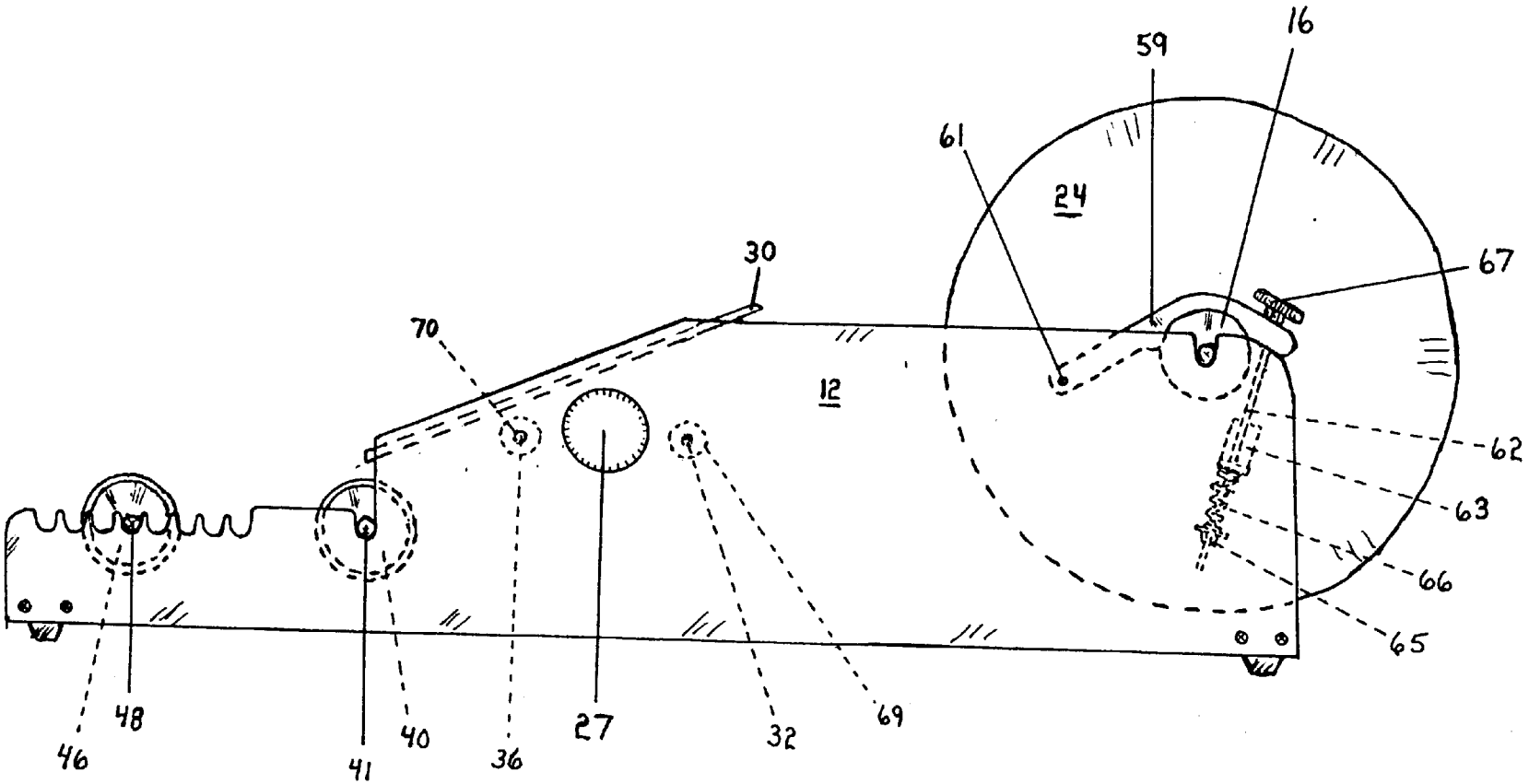
FIG. 3 is a side view of the embodiment depicted in FIG. 1.

Attention is invited to FIGS. 1 and 2, which offer an overview of a preferred embodiment of the apparatus of the invention. Most of the components of the apparatus are fashioned from lightweight metal, such as aluminum, or from lightweight steel alloys, and/or plastics, to provide a durable yet lightweight and inexpensive apparatus. The apparatus features a frame 10 having a pair of preferably parallel side panels 12, 13, upon which most of the other components of the apparatus are mounted. Two or more cross members 15, 15' lend structural integrity to the frame 10. The elements of the frame may be crafted from anodized aluminum. Preferably, the frame's precision milling allows the other moving parts of the apparatus to operate in close alignment to give consistently exact label placement. The frame 10, including the bottom edges of the side panels 12, 13, is configured to rest firmly upon a level supporting surface, such as a tabletop or workbench. The side panels 12, 13 are milled with the adjusting slots, stationary slots and notches, bearings, threaded mounting holes, and other features permitting the assembly and operation of the apparatus as will be further described. Rubber feet, plastic glides, or the like optionally may be mounted on the bottom of the frame 10 (e.g. on the undersides of the cross members 15, 15') to prevent the apparatus from sliding on, or marring, the supporting surface.

Extending between the side panels 12, 13, near the rear of the apparatus, is a feed reel 16 upon which a conventional spool of pressure-sensitive adhesive labels may be disposed and from which the labels, on a strip of substrate 50, are paid out during operation of the invention. An adjustable separator plate 30 is disposed medially in the frame 10 and extends between the side panels 12, 13 at an oblique angle with respect to the supporting surface. Separator plate 30 provides an edge 31 about which the label substrate strip is sharply wrapped to induce separation of the labels from the substrate 50, as will be further described. Beneath the separator plate 30 is at least one, and preferably two, guide rollers 32, 36 which guide the movement of the label strip through the apparatus. Toward the front of the apparatus are label detachment roller 40 and seating roller 46, which also extend between the side panels 12,13, and whose respective functions also will shortly be described. As seen in the figures, the frame 10 preferably is configured to hold the feed reel 16 at a height above the detachment roller 40 and the seating roller 46, which are held at about the same level in the frame. During the practice of the invention, the label strip substrate is fed from the feed reel 16, guided by and past the guide rollers 32, 36, around the edge 31 of the separator plate 30 (where the labels are separated from the substrate and applied to the article), across the separator plate 30 and back to the feed reel 16, resulting in the smooth and uniform application of the labels to articles A consecutively placed upon the label detachment roller 40 and the seating roller 46, all in a manner further to be described.

The feed reel 16 is disposed at a back of the frame 10 extending between, and preferably perpendicular to, the side panels 12, 13. The feed reel 16 is a cylindrical roller 17 rotatable, as with ball bearings, around and upon a shaft 18. The ends of the shaft 18 are removably disposable in corresponding notches or slots 20 in the upper edges of the side panels 12, 13. Optionally but preferably, the ends of the shafts and the notches are crafted to have interlocking shapes so as to encourage the rollers to rotate on the shafts, rather than the shafts rotating in the notches. For example, the ends of the shaft 18 may be provided with a hexagonal cross section, so that it rests non-rotationally in a square notch 20.

A pair of label spool guide collars 24, 24' are disposed upon the roller 17 of the feed reel 16. Spool collars 24, 24' are slidably movable axially along the feed reel 16, but their positions upon the reel 16 are releasably fixable as by set screws or the like.

Spool collars 24, 24' hold the label strip spool in a selected position upon the feed reel 16, e.g, approximately equidistant from each end of the reel 16. However, the distance between the collars 24, 24' may be varied to adapt the apparatus to accommodate label spools (and thus labels) of varying sizes. Also, the position of the collars 24, 24' may be selectively adjusted anywhere along the length of the feed reel 16, so as to permit the labels to be placed at a selected position along the axial length of the article A to be labeled. (The reel 16 optionally is provided with a centering mark to aid in locating its mid-points for placing the roll in the desired location.) Preferably, a set screw (not shown) in the hub of each spool collar 24, 24' may be turned to contact the roller 17 and fix each guide in the selected position upon the roller 17, or reversed to permit the collar to be slidably shifted axially upon the roller. Thus, the collars 24, 24' contain and constrain the label roll against axial movement along the feed roller 17 during use, yet permit side to side axial adjustment along the roller to allow selective axial positioning of the label on the article A. Optionally, the hub on each collar 24, 24' also mounts one or more axially situated screws, turnable parallel to the feed reel roller 17. Such axial screws can be tightened to flex the collars axially inward, better to compress the label roll disposed between the collars; during the practice of the invention, the label roll must not "free wheel" on the feed reel, rather the rotation of the label roll is accompanied by a corresponding rotation of the entire feed reel 16.

Figure 4:
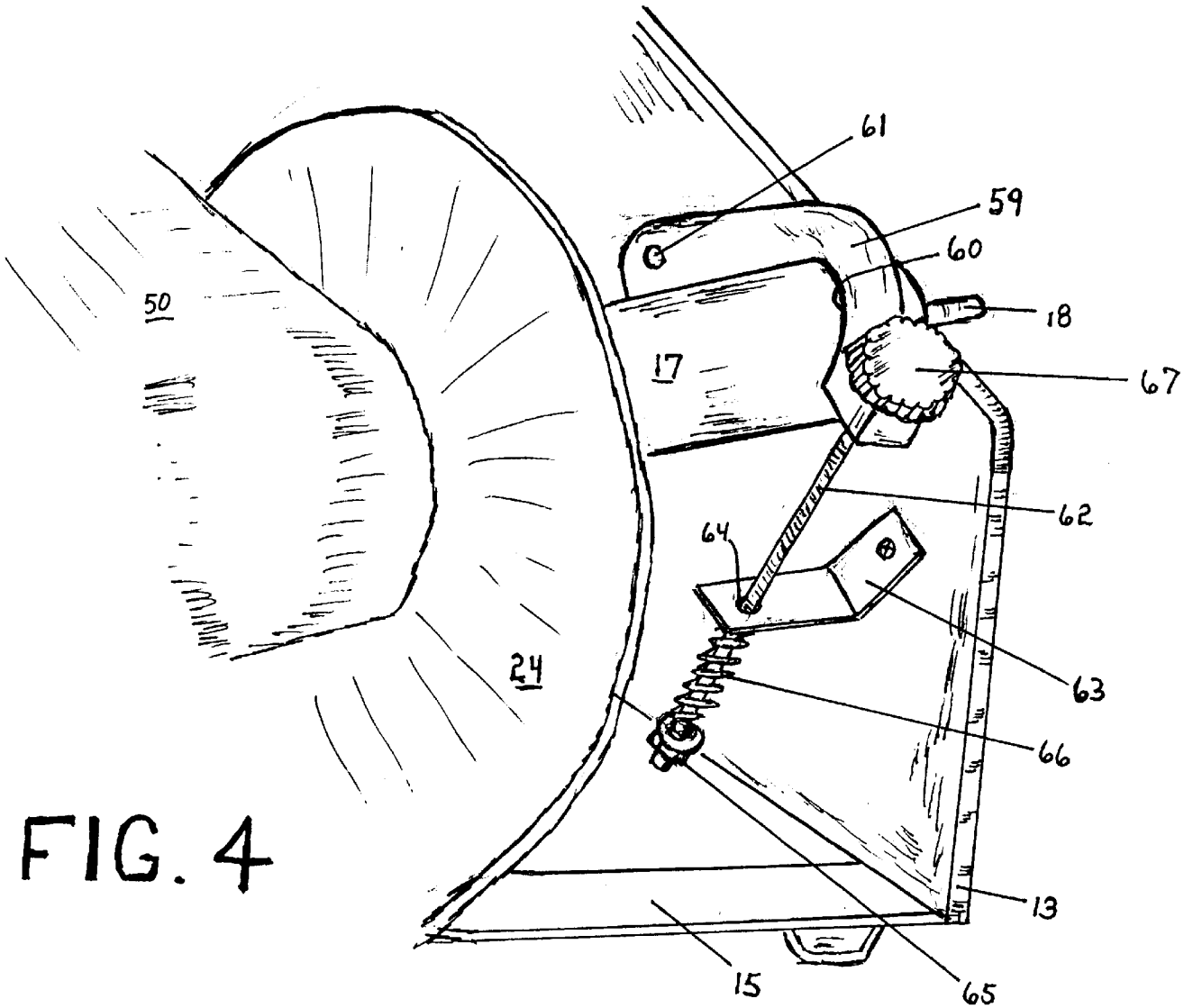
FIG. 4 is an enlarged rear view of a portion of the embodiment depicted in FIG. 1, showing the feed reel brake mechanism.

The rate at which the feed reel 16 can rotate preferably is selectively controllable by at least one, preferably a pair, of brakes 58, best seen in FIGS. 2 and 4. Description of a single brake 58 describes either one of a pair. In the preferred embodiment, there is a brake 58 provided on each of the side panels 12 and 13, at each end of the feed reel 16. Each brake 58 includes an arm 59 pivotally connected to the inside face of a side panel 12 or 13 by a pivot pin or axle 61. Arm 59 extends from its point of connection to the side panel 12 or 13 up to the surface of the feed reel roller 17. Arm 59 is provided with an arcuate pad surface 60 having a radius of curvature corresponding generally to the radius of the roller 17, so that in operation the pad surface rests in flush contact with a portion (e.g. about 90° to about 120°) of the circumference of the roller 17. A brake bracket 63 having a leg defining a hole 64 therein is attached to the inside of the side panel 12 generally below and to the rear of the feed reel 16. The spring tensioners or brakes thus serve to arrest the substrate strip or web from advancing once a label has been applied, to help prevent inadvertent double-labeling. With only a minor bit of practice, an operator can adjust the brakes 58 so that the label strip pays out only when the operator is manually rotating an article A upon the detachment and seating rollers 40 and 46, in contact with the friction sleeve 45, as will be further described.

A brake adjustment screw 62 is threadably engaged through a threaded aperture in the distal end of the arm 59, and extends downward through the hole 64 in the brake bracket 63. A lock nut 65 upon the lower end of the brake adjustment screw 62 holds brake spring 66 in a state of mild compression upon an intermediate portion of the adjustment screw, between the distal end of the brake arm 59 and the protruding leg of the bracket 63, as best seen in FIG. 4. The compression of the spring 66 pushing against the bracket 63 (and the lock nut 65) urges the pad surface 60 to press against the surface of the roller 17, thereby braking the rotation of the feed reel 16. A brake knob 67 fixed upon the upper end of the adjustment screw 62 and in contact with the upper surface of the arm 59 allows the screw 62 to be turned manually; the screwed action of the screw 62 resulting from the rotation or counter-rotation of the knob 67 with respect to the arm 59 gradually and controllably adjusts the distance between the lock nut 65 and the brake bracket 63, and thus adjusts the compression in the spring 66 and the force with which the arm 59 presses against the roller 17.

The brake 58 serves to hold the feed reel shaft 18 in place within the feed reel slot 20 during operation of the invention, an also allows the user to adjust the ease with which the feed roller rotates. The selective turning of the brake knob 67 accordingly permits the user to increase or decrease the braking force of the arm 59 resulting from the friction between the pad surface 60 and the roller 17 of the feed reel 16. Experienced users of the apparatus may find that a comparatively free-wheeling feed reel 16 allows them to use the apparatus quickly and effortlessly. Others, particularly unpracticed users, may appreciate the application of the brake 58 to slow the rate at which the feed reel 16 may rotate to prevent accidental double-labeling and other mishaps. Again, by rotating the brake knob 67 each user may,tune the force of the brake and thus adjust the "feel" of the apparatus to suit his or her individual preference.

Reference is returned to FIGS. 1 and 2. An article A to be labeled is rested upon the detachment roller 40 and the seating roller 46, the axes of these rollers being parallel to each other and to the axis of the article. The rollers 40, 46 thus serve as a rollable cradle for the article, upon which the article A is manually rolled to operate to practice the invention.

The label detachment roller 40 is situated toward the front of the frame 10 for allowing detachment of the labels from the substrate and placement of the labels on a article A to be labeled. The label detachment roller 40 is of similar construction to that of the feed reel, i.e., includes a cylindrical roller 41 rotatable about a central shaft 42. The ends of the detachment roller shaft 42 rest in corresponding notches or slots 44 in side panels 12, 13. A friction sleeve 45 is disposed medially on the detachment roller to provide a mild frictional engagement is with the label substrate during operation of the apparatus. Sleeve 45 may be separate element wrapped around the roller 41 and made from fabric, rubber, plastic or the like, or alternatively may be a rough or frictional material coating applied directly to the roller and cured in place. Sleeve 45 only need be fashioned from a material which readily provides modest frictional engagement with a substrate 50 when the substrate is pressed against it. Preferably, the sleeve 45 is fashioned from a looped pile fabric, such as the looped component of a Velcro® (fabric fastener, which provides a suitable level of friction between the substrate and the detachment roller 40.

Forward on the frame 10 from the detachment roller 40 there is provided the seating roller 46 upon which the article A to be labeled rests for labeling. Seating roller 46, like the other roller 40 and the feed reel 16, has a roller rotatably mounted upon a shaft 48. The ends of the shaft 48 rest in and are held by a corresponding pair of a plurality of adjustment slots 52, 53 in the side panels 12, 13. As depicted in FIG. 1, the article A is situated between and upon, and supported by, the detachment roller 40 and the seating roller 46. During the practice of the invention, the article A is "rolled" upon the rollers 40, 46, and as the article rolls, the rollers 40, 46 in contact with the article rotate upon their respective shafts 42, 48.

Continued reference is made to FIGS. 1 and 2. The side panels 12, 13 define therein a plurality of opposing adjustment slots 52, 52', 53, 53' for adjusting the position of the seating roller 46, from back to front of the frame 10, to accommodate a variety of article sizes. Reference to FIG. 1 illustrates that the distance between the detachment roller 40 and the seating roller 46 may be varied by selecting the associated opposing pair of adjustment slots 52, 52', 53, 53' in which to situate the ends of the shaft 48 of the seating roller 46. To adjust the position of the seating roller 46, the roller is lifted up and out of any pair of slots 52, 52', 53, 53' and replaced into some other associated pair of slots. The closer to the detachment roller 40 the seating roller 46 is located, the smaller the article that can be manipulated in the apparatus to receive a label. To accommodate an article of greater diameter, the seating roller 46 is adjustably moved further from the detachment roller 46, i.e., toward the front of the frame 10. Accordingly, the plurality of opposing slots 52, 52', 53, 53' are for removably adjusting the position of the seating roller 46 from back to front of the frame 10 to accommodate small to large articles of a wide variety of diameters.

At least one, and preferably two, end rings 54, 54' are disposed upon the seating roller 46 to maintain the proper position of the article upon the roller 46. Each ring has a set screw engageable against the roller 46 to temporarily fix the axial position of the ring 54 or 54' upon the roller. Disengaging the set screw from the roller 46 permits the rings 54, 54' to be controllably slipped axially along the roller to select the distance between them to accommodate articles of different heights; re-engaging the set screws then temporarily fixes the rings against axial movement or radial slippage around the roller 46. End rings 54, 54' are thus selectively positioned to hold the article to be labeled in the proper axial position with respect to the rollers 40, 46 so that the labels are placed in proper position on the article.

The labeling apparatus features the adjustable separator plate 30 which extends between the side panels 12, 13, and is situated between the feed reel 16 and the detachment roller 40. As best seen in FIG. 2, the separator plate 30 fits into angled plate slots 33 defined in the inside faces of the side panels 12, 13. Plate slots 33 hold the separator plate 30 in an oblique position so that the front edge 31 is lower than the rear edge 34 of the plate, i.e., the separator plate 30 preferably is tilted or inclined "downwardly" from the feed reel 16 toward the front of the frame 10 and toward the detachment roller 40.

A threaded rod 26 is screwably engaged through both the side panels 12, 13; screwed turning of the threaded rod induces lateral movement of the panels. Thus, that the clockwise manual rotation of a knob 27 fixed to an end of the rod 26 flexes the side panels to draw them slightly closer together. Counterclockwise rotation of the knob 27 actuates the screwed movement of the side panels 12, 13 to bow them slightly further apart.

The separator plate 30 is movable along and in the angled slots 33 (i.e. frontward and backward with respect to the frame 10) to adjust the distance between the front edge 31 of the separator plate and the label detachment roller 40. Counter rotation of the knob 27 permits the user to flex outward the center portions of the side panels 12, 13 to release the separator plate to slide in angled slots 33 to permit the selective adjustment of the position of the separator plate. After the plate 30 has been slidably moved to the selected position in relation to the label detachment roller 40, the knob 27 is rotated to flex the center portions of the side panels toward one other thereby to squeeze or frictionally grip the plate 30 there between and temporarily fix the plate's position in the angled slots 33. The adjustability of the plate 30 permits the apparatus to be adapted to apply labels to specially or non-uniformly shaped articles.

As best seen in FIG. 2, a pair of horizontal guide rollers 32, 36, such as steel rods, are located generally medially in the frame 10, extending perpendicularly between the side panels 12, 13. Guide rollers 32, 36 serve to guide the movement of the label substrate through the apparatus during operation, mainly to assure that the labels are consistently applied at the same location upon each successive article. Each guide roller 32, 36 is a metal rod, each end of which is inserted in a corresponding cavity in the inside faces of the side panels 12, 13 for rotation on, for example, shielded bearings imbedded therein. The contact between the ends of the guide rollers 32, 36 and the side panels 12, 13 may be lubricated or provided with bushings to facilitate smooth and easy rotation of the rollers 32, 36. Upon each guide roller 32, 36 is a pair of substrate guide rings 69, 69' and 70, 70'. Guide rings 69, 69', 70, 70' have central apertures there-through with diameters approximately equaling the outside diameters of the rods of the guide rollers 32, 36, so that there is substantial frictional engagement between the guide rollers and the guide rings. Guide rings 69, 69', 70, 70' yet may be manually slipped along the lengths of the guide rollers 32, 36 to adjust the positions of the rings 69, 69', 70, 70' thereon, both to adjust the distance between associated pairs of guide rings and to select their positions along the axial length of the guide rollers 32, 36. Friction between the rings 69, 69', 70, 70' and the rollers 32, 36 is adequate to hold the rings in place once they have been slipped to their selected positions by the user.

Figure 5:
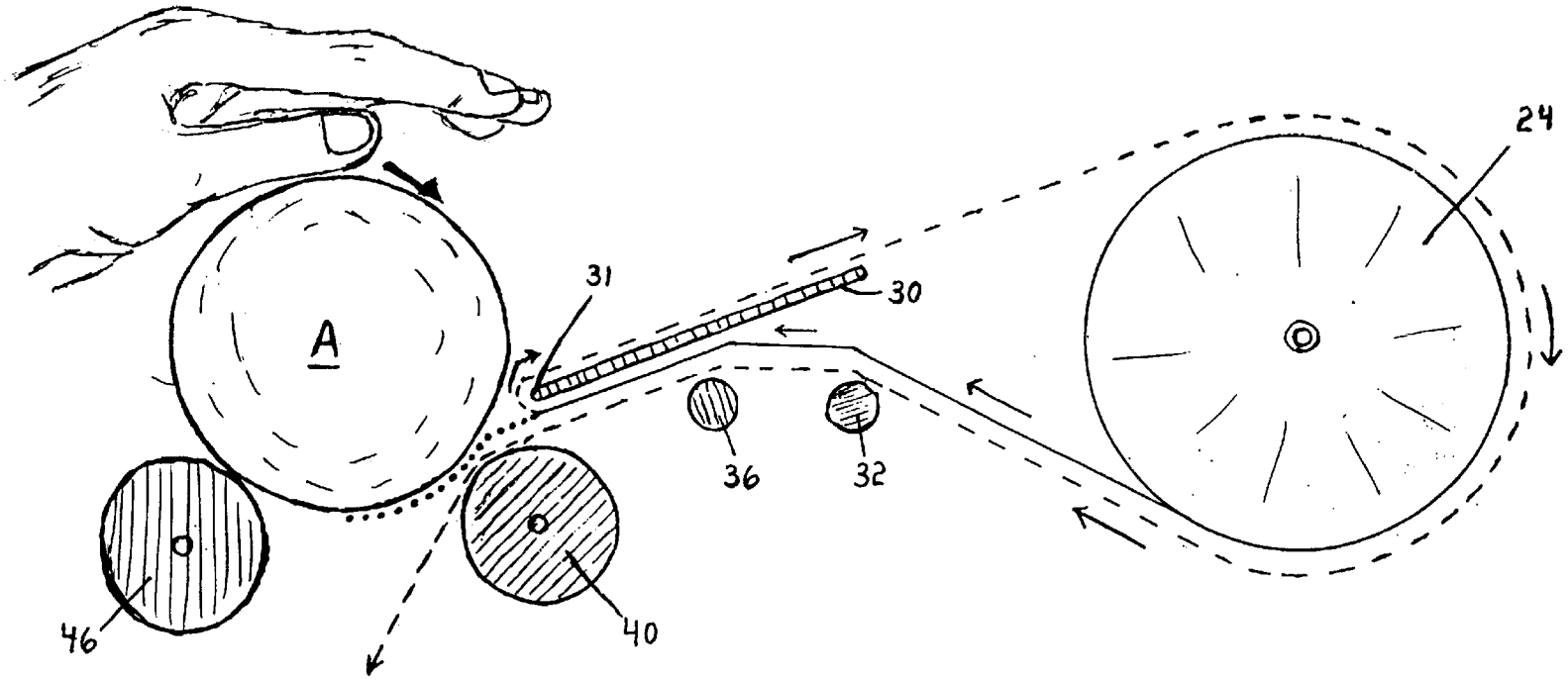
FIG. 5 is a diagram of certain of the components of the embodiment depicted in FIG. 1, illustrating the preferred flow path of the label-bearing substrate through the apparatus of the invention.

The side view in FIG. 5 shows the path of the substrate through the apparatus during the operation of the apparatus. In FIG. 5, substrate bearing labels thereon is shown by a solid line; labels peeled from the substrate are shown by a dotted line, and substrate with the labels removed therefrom is shown by a dashed line. In the preferred embodiment, the apparatus is actuated by the user's manually applying a gentle, consistent downward pressure upon the article A with a rolling action (clockwise in FIG. 5), as indicated by the large directional arrow.

Figure 6:
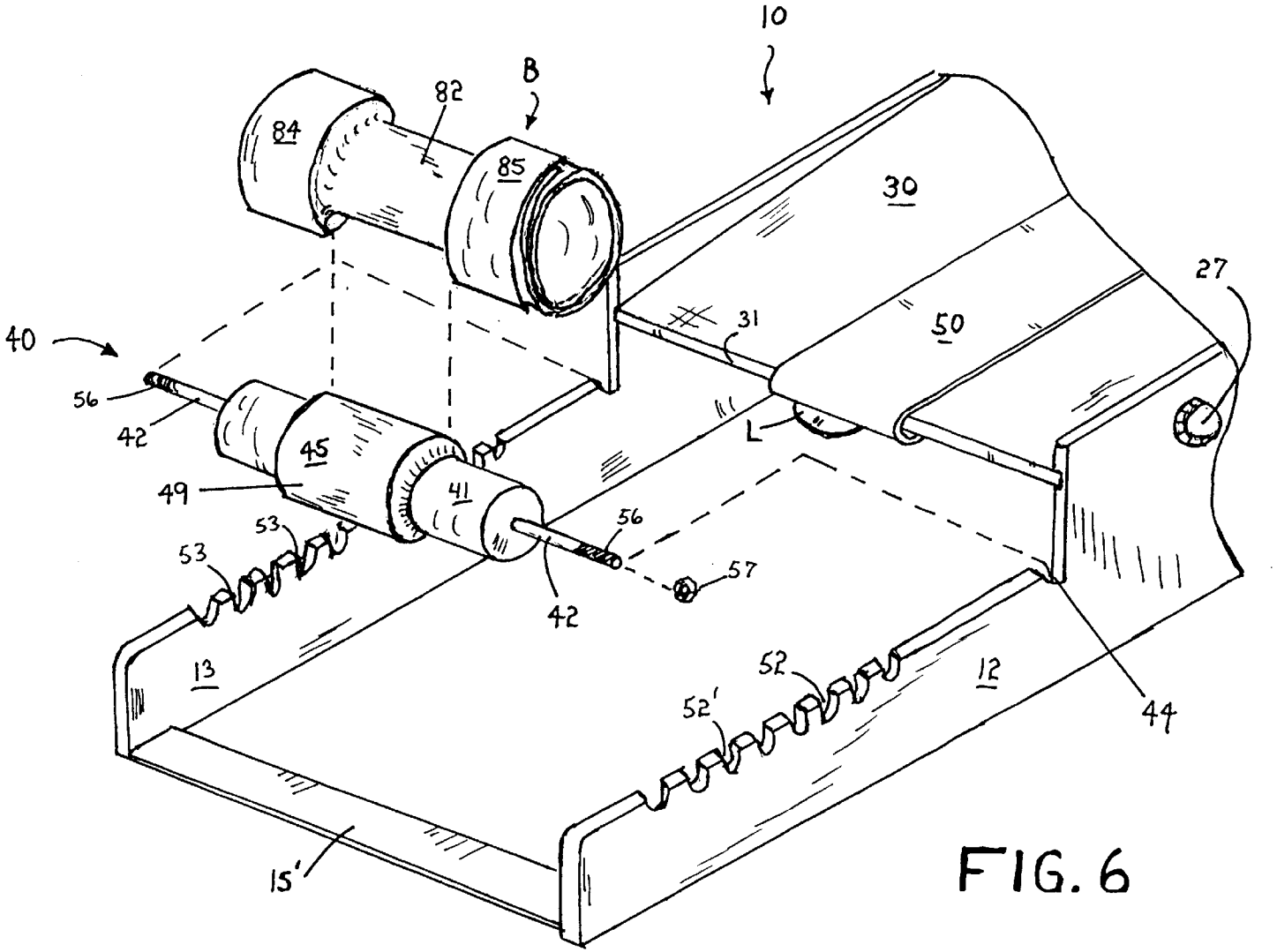
FIG. 6 is a perspective, partially exploded view of a portion of an alternative embodiment of the apparatus, showing a specialized label detachment roller for applying labels to irregularly-shaped articles.

Reference is made to FIG. 5. The spooled substrate, with the labels thereon, is paid from the underside of the feed reel 16. The label-bearing substrate moves forward to the guide rollers 32, 36. The guide rollers 32, 36 support the label-bearing substrate, and the guide rings 69, 69', 70, 70' on the guide rollers serve to direct the label-bearing substrate to the appropriate position on the label detachment roller 40. Upon attaining the front edge 31 of the separator plate 30, the substrate wraps sharply up and around the front edge as indicated by the directional arrow accompanying the dashed line in FIG. 5. The abrupt bending of the substrate causes the less pliable label, designated by the dotted line in FIG. 5, to separate from the substrate and to come in contact with and adhere to the article A. Additional insight into the function of the apparatus in this respect may be had with reference to FIG. 6, showing the waste substrate S upon the separator plate, with a label L in the incipient stage of detachment or separation from the substrate where the substrate wraps around the edge 31 of the separator plate.

The waste substrate, without any labels disposed thereon (dashed line), continues up along the upper surface of the separator plate 30, again as suggested by a directional arrow in FIG. 5, and is passed over and around the spooled label-bearing substrate upon the feed reel 16. The substrate (still designated by a dashed line) makes a single pass around the backside of the feed reel 16, and returns again to the guide rollers 32, 36. The used substrate, not bearing any labels, passes over the guide rollers 32, 36, beneath the label-bearing substrate (solid line in FIG. 5), i.e., the "spent" substrate without labels thereon feeds between the guide rollers 32, 36 and the label-bearing substrate being dispensed from the feed reel 16. After passing over the guide rollers 32, 36, the substrate passes over the label detachment roller 40, between the detachment roller and the article A to be labeled. After being pinched between the detachment roller 40 and the article A, the used substrate is passed out of the apparatus to be collected as waste.

In the preferred embodiment, the movement of the substrate as described is driven by the user's manual rotation of the article A. As seen in FIGS. 1 and 5, the labels (dotted line in FIG. 5) and "empty" substrate (dashed line in FIG. 5) are pressed or pinched between the article A and the detachment roller 40. As the user urges the article A down against the detachment roller 40, the empty substrate is pressed against the friction sleeve 45 on the detachment roller 40. Also, as the labels (dotted line in FIG. 5) are separated and pulled from the "loaded" substrate (solid line in FIG. 5), they are pressed between the article A (to which they adhere) and the empty substrate. As the user "rolls" the article A to rotate it (clockwise in FIG. 5), the rotation of the article imparts rotary motion to the detachment roller 40 via the traction of the empty substrate. The rotation (counterclockwise in FIG. 5) of the detachment roller 40, and the rotation of the article A, with the empty substrate there-between, pulls the empty substrate downward from the detachment roller 40. This pulling motion of the empty substrate is transmitted throughout its length, resulting in the motion of the substrate indicated by the directional arrows in FIG. 5. As the empty substrate is pulled between the article A and the detachment roller 40, the empty substrate is pulled across the top of the separator plate 30, around the feed reel 16, and across and above the guide rollers 32, 36.

Movement of the empty substrate across the top of the separator plate 30 results in substrate "loaded" with labels being pulled and dispensed from the spool on the feed reel 16 (causing the feed reel to rotate clockwise in FIG. 5) as loaded substrate is paid out from the feed reel. Continued rotation of the article A continues to pull the empty substrate, as substrate bearing labels is moved across the guide rollers 32, 36 toward the detachment roller 40. As the "loaded" substrate is pulled toward the detachment roller 40, it approaches the front edge 31 of the separator plate 30. As the label-bearing substrate (solid line in FIG. 5) reaches the front edge 31, the leading edge of each label separates from the substrate as the substrate wraps tightly around the front edge of the separator plate. As the article A continues to roll and thus rotate the detachment roller 40, the empty substrate (dashed line in FIG. 5) continues to be pulled by the pinching action of the article and detachment roller. The resulting movement of the empty substrate continues to feed the label-bearing substrate past the front edge 31 of the separator plate, allowing the leading edge of the label to contact and adhere to the rolling article A. Because the leading edge of the label is adhered to the article A, the continued rotation of the article A pulls the label from the substrate as the substrate continues to move around the edge 31 and on to the top of the separator plate 30. The label (dotted line in FIG. 5) detaches entirely from the substrate, and is adhered into proper position upon the article A as the label is rolled between the article A and the detachment roller 40. Once the label has been separated from the substrate and pressed into place around the surface of the article A, the article is removed from its situation upon the detachment and seating rollers 40, 46. Another article A is then placed in position upon the rollers 40, 46, and the process is resumed. The process is repeated with a series of articles serially placed in position upon the rollers 40, 46 to meet each label as it becomes available at its point of departure from the substrate in the immediate vicinity of the front edge 31 of the separator plate.

The practice of the invention is apparent from the foregoing. At the outset, of course, the user identifies the articles to be labeled, such as plastic bottles, and the labels to be applied. The spool bearing the substrate having the labels thereon is placed upon the feed reel 16. Placement of the spool upon the feed reel 16 is accomplished by loosening or undoing one or both reel brakes 58 (by rotating the brake knob 67) and lifting the feed reel out of the feed reel slots 20. One or both the label roll guides 24, 24' are slipped off the roller 17 after first loosening the set screws in their respective hubs. The spool of labels is slipped upon the roller 17 of the feed reel, and the guides 24, 24' are replaced upon the roller and secured in proper position by the tightening of their set screws. The user has previously determined where (top-to-bottom) on the article the labels are to be placed, and fixes the position of the guides 24, 24' (and thus the spool of labels) accordingly. For example, if the labels are to be placed "high" upon a bottle, the label substrate spool and the guides 24, 24' are temporarily fixed near one end of the feed reel 16.

Importantly, the roll of labels must not "free wheel" on the feed reel 16. The roll of labels should be squeezed slightly between the collars 24, 24', by compressing the collars against the label roll and tightening the set screws on their respective hubs. Alternative embodiments may be provided with other means for tightening the collars against the roll. For example, a plurality of radially symmetrically arranged "allthread" screws may be provided to extend between the collars 24, 24' (parallel to the feed reel 16) and/or auxiliary nylon adapter donuts disposed upon the reel 16 alongside the collars. Nuts on the ends of each allthread screw may then be loosened and tightened to adjust the compression of the collars.

An advantage of the invention is here highlighted. Label substrate may be wrapped upon a spool to be either "right edge leading" or "left edge leading"; that is, whether the right side or the left side of the each label is nearer the "free" end of the spooled substrate depends upon the direction in which the substrate was wound upon the spool. The present invention permits the spooled labels to be placed upon the feed reel 16 so that the free end of the substrate pays out from underneath the feed reel, as seen in FIG. 5, without regard for whether the labels are right edge leading or left edge leading. The user can accommodate either type of label presentment at the edge 31 of the separator plate 30 by selecting the proper placement of the article A upon the rollers 40, 46. The apparatus can receive the article A with its top toward the left side of the frame 10 and its bottom toward the right side, or the article may be inverted visa-versa, so that whichever edge of the labels lead, the labels are properly (not upside down) applied to each article. Stated differently, the article can be flipped 180 degrees for accommodating either a left edge leading or right edge leading labels. Thus, the present invention is versatile to accommodate either left edge leading or right edge leading type labels.

Once the spool of labels has been properly placed upon the feed reel 16, the user may then adjust the seating roller 46 to receive the articles to be labeled. First, the user determines which pair of seating roller adjustment slots 52, 52', 53, 53' in which to dispose the ends of the shaft 48 of the seating roller 46; larger diameter articles are accommodated by increasing the distance between the seating roller and the detachment roller 40. Similarly, even articles of very modest diameter may be labeled by the apparatus of the invention by disposing the seating roller 46 in a corresponding pair of adjustment slots 52, 52', 53, 53' nearer or nearest the detachment roller. The range of sizes of articles that can be labeled by the apparatus of the invention depends upon the size of the apparatus itself; various sizes of apparatus may be constructed to accommodate different labeling needs without departing from the scope of the invention.

The user also may adjust the end rings 54 upon the seating roller 46 by loosening the set screws therein and sliding them along the seating roller. The end rings 54 are fixed in place by re-tightening their set screws, in proper positions upon the seating roller corresponding to the proper axial locations of the top and bottom of the articles to be labeled. For example, the end rings 54 may be positioned to maintain the article to be labeled nearer one end of the roller 46 if the labels are being affixed "high" on the article, or may be placed to hold the article about centrally upon the rollers 40, 46. Thus, the end rings 54 preferably are used to hold the article against axial movement along the rollers 40, 46 during operation of the invention. The movability of the end rings 54 allows the apparatus to be adapted to receive articles of a wide variety of heights.

The position of the separator plate 30 is adjusted by loosening the knob 27 and sliding the separator plate until its front edge 31 is between about 0.3 cm and about 0.9 cm from the nearest tangent of the article A. The distance of the edge 31 from the surface of the article A is a matter somewhat of personal taste. However, the principal advantage of providing a slidably adjustable separator plate 30 is to permit odd-shaped articles to be labeled, as will be shortly be described.

The guide rings 69, 69', 70, 70' are selectively positioned to correspond generally to the axial positions of the collars 24, 24 and the end rings 54, 54'. It is seen, therefore, that the apparatus is configured for use by positioning the end rings 54, 54' to accommodate the height of the article A to hold it in axial position upon the detachment and seating rollers 40, 46. The user then selectively locates the collars 24, 24' so as to determine the desired position of the labels in relation to the axis of the article A. The guide rings 69, 69', 70, 70' are aligned with the collars 24, 24' so to direct the paid-out substrate generally perpendicular to the axes of the feed and detachment rollers 16, 40.

The user may adjust the brake 58 to his or her taste.

The label-bearing substrate may then be "threaded" into the apparatus for use. The substrate is unwound from the spool so as to depart from beneath the feed reel 16, and is disposed between the guide rings 69, 69', 70, 70' (the guide rings being separated by a distance generally equivalent to the width of the substrate strip). A leader length of the substrate, without labels, is wrapped around the front edge 31 of the separator plate and then drawn back and passed once more around the spool and the feed reel 16. The leading end is then drawn across the guide rollers 32, 36 between the guide rings 69, 69', 70, 70', and then pinched between the first article A and the label detachment roller 40. The Article A is rolled manually until the edge first label on the roll emerges from beneath the edge 31 of the separator plate 30. The article is then in position for use.

Further rolling of the article A results in the leading edge of the label contacting and adhering to the surface of the article. As the article rolls, it presses against the friction sleeve 45, with the label pressed there between and thereby rolling the adhesive label onto the article for adhesive application thereto. As one label is completely applied to a first article, the leading edge of the next label begins to emerge from beneath the fro edge 31, at which time the first article is removed from the rollers 40, 46 and a second one is placed thereon and the process repeated to apply the next label to the second article, and so forth. Because the apparatus maintains the strip of label substrate generally perpendicular the axis of the article A, the labels are dispensed for straight, aligned application onto the articles.

FIG. 6 illustrates an alternative embodiment that may be used to apply labels to articles having non-uniform shapes. It may be desired, for example, to apply labels to the recessed surface 82 of a bottle B having different diameters along its axial height. A stylized bottle B may have terminal sections 84, 85, whose cross sections are circular and have equal diameters, but whose diameters exceed the diameter of the medial recessed portion 82. FIG. 6 exaggerates, for illustrative clarity, the difference in diameters between the medial portion 82 and the terminal portions 84, 85; with most bottles and other containers, the diametrical differences are considerably more subtle, but may still necessitate the use of an alternative embodiment of the invention.

The alternative embodiment of FIG. 6 is the same in all respects to the preferred embodiment previously described, except that a modified version of the label detachment roller 40 is provided. As observed in FIG. 6, the detachment roller 40 has a main roller portion 41 and a central label-contacting portion 49 of comparatively larger diameter. The difference in diameters between the main roller portion 41 and the central label-contacting portion 49 corresponds generally to the differential between diameter of the medial portion 82 and of the terminal portions 84, 85 of the bottle B. Also, it is preferable that the axial extent of the label-contacting portion be about equal to, and no greater than, the axial length of the medial portion 82 of the bottle. The fall surface of the label-contacting portion 49 is covered with the friction sleeve 45 previously described.

One of ordinary skill in the art will immediately appreciate that the label-contacting portion 49 may be an interchangeable element that is releasably mounted upon a standard main roller 41. Thus, a kit pertaining to the invention may have a single standardized main label detachment roller 41, and a wide variety of interchangeable label-contacting portions of differing diameters and axial length, which may selectively be slipped on and off the main roller 41. The user is thus afforded the ability to customize his apparatus to an assortment of different article shapes.

This embodiment of the invention make extra beneficial use of the adjustability of the separator plate 30. Once the user has disposed a properly customized roller, with label-contacting portion 49, into the apparatus by situating its shaft 42 into the slots 52, 53, the knob 27 can be turned to release the grip of the side panels 12, 13 on the plate 30. The plate 30 can then be carefully slipped forward or backward to bring its front edge 31 into parallel spaced relation (e.g. about 0.6 cm) with the working surface of the friction sleeve 45 on the label-contacting portion 49 of the detachment roller 40. Such adjustment generally is a requirement of this alternative embodiment of the invention, and must be somewhat more meticulously performed, in order to obtain optimal performance of the invention. Such adjustment, however, is readily learned by the practice of the invention after little or no experimentation, and to suit the user's individual preference.

FIG. 6 also illustrates that each of the shaft 42 of detachment roller 40 (of the shaft of any of the rollers 16, 46) may be threaded 56 for engagement with a corresponding nut 57 to permit fine adjustment of the axial shifting of the roller 40 in the frame 10 as the shaft rests in a pair of slots 52, 53.

The alternative embodiment seen in FIG. 6 is then supplied with label substrate 50 and a seating roller (not shown in FIG. 6) as previously described for the preferred embodiment, and is operated in generally the same manner. The larger-diameter terminal portions 84, 85 of the bottle B ride against and rotate on the rollers 40, 46, while the medial label-contacting portion 82 serves to press the label L against the recessed surface (i.e. 82) of each bottle B. The waste substrate 50 is then passed on to the feed reel to be re-wound thereon as previously described.

The method of the invention is recapitulated, and as thus described, features three main aspects: the loading of the label roll on the feed reel, the threading of the substrate through the apparatus, and the placement of the labels on the articles.

Loading the Feeder Spool

1. Place one collar 24 onto the roller 17 of the feed reel 16 and slide it into the desired position.

2. Slide the roll of labels on over feeder roller 17, so that the roll feeds from the bottom.

3. Slide the second collar 24' onto the roller 17 of the feed reel.

4. Center the label roll by pushing the roller 17 left or right. Use a ruler to make sure that length of roller 17 extending out on both sides is identical. The roll of labels is now centered. Tighten the set screws in the hubs of one 24 of the collars, press the other collar 24' firmly against the roll of labels, and tighten the set screws in the hub of the second collar 24'. The roll of labels is now be locked on the roller 17. If the roll of labels still "freewheels" on the roller 17, one of the collars is loosened, tightened against the roll, and its set screw reset. Thereafter when a new label roll of the same size is needed, only one of the collars 24 or 24 need be removed and replaced.

5. Place the ends of the shaft 18 of the feed reel 16 into the far rear slots 20, 20' on the frame 10.

6. Flip the arms 59 of the brakes 58 over the to of the feed reel roller 17 so that the arm pad surfaces contact the roller.

7. Engage the brake spring assembly and turn the brake adjust screw 62 until there is braking action on the feed roller 17.

8. The leading edge of labels should be unwinding from the bottom of the label roll. About three feet of empty "leader substrate at the beginning to the roll is needed to "prime" the apparatus.

9. The threading of the apparatus requires at least 3 feet of empty label substrate at the beginning of the roll. It is preferable to save waste substrate from previous rolls to tape to the beginning of fresh rolls, or to hand label the necessary amount of labels to make 3 feet of empty substrate. (If a roll of labels is removed from the apparatus before it is exhausted, simply tear off the waste substrate below the apparatus, and roll the feed reel 16 backwards. This leaves the required empty liner on the roll for future use.

10. Adjust both guide-rollers 32, 36 by sliding the small rings 69, 69', 70, 70' until their inner edges are separated by a distance about equal to the width of the substrate strip. Like the collars 24, 24', the pairs of rings 69, 69', 70, 70' should be centered, that is, equidistant from the midpoint of each roller 32, 36.

11. Thread the substrate over the top of the rear guide roller 32, under the threaded rod 26, over the front guide roller 36 and between the detachment roller 40 and separator plate 30.

12. Pull the substrate until the leading edge of the first label appears between the leading edge 31 of the separator plate 30 and the top of the detachment roller 40. (See FIG. 6)

13. Lift the empty "lead" substrate over the top of the label roll, back around the label roll, and re-thread it back through the exact same path as the first threading of steps 15 and 16. Allow the leading edge of the empty leader substrate to drape over the detachment roller 40 and run out the front of apparatus under the front cross member 15' and eventually on to the floor. This unique threading routing is an advantage of the invention.

The apparatus is now threaded and ready to adjust for the size of the articles to be labeled. The apparatus is adapted to receive a particular size of article by selecting the appropriate detachment roller 40, and positioning the movable seating roller 46 to fit the jar, bottle, or the like.

Label Position Adjustments

The location where the label will be placed on the article is determined by the adjustable end rings 53 on the movable seating roller 46. By moving the rings 53, 53' axially to the left and right, the operator may selectively control how "high" or how "low" the label will adhere to article. Once set, the label position will be the same on every subsequently labeled article of the same size in the labeling "run."

The leading edge of the empty leader liner is hanging off the edge of the counter or table top, and under the front cross member 15'. The brakes 58 should be tightened enough to be applying some braking action to the feed reel roller 17.

The separator plate 30 is then positioned. With an article resting on the rollers 40, 46, the knob 27 is loosened, and the edge 31 of the separator plate 30 is brought to within about 0.2 cm to 0.3 cm of touching the article. The edge 31 may barely contact the friction sleeve 45 on the detachment roller 40. The squeezer knob 27 is then tightened to secure the separator plate 30. The edge 31 should not actually touch the article.

Placement of the Labels on the Articles

If the user is right-handed, the finger tips of the right hand are placed on top of and in the middle of the article to be labeled. With the left hand, the "tail" of bare leader substrate is grasped just below the machine. The user rolls the article in the cradle of rollers 40, 46 by pushing firmly down and away (going from finger tip to palm as if rolling dough), while simultaneously pulling slightly on the leader substrate to start the method. Importantly, the leader substrate will need to be pulled no more than about 2.5 to start the process. If the leader is over-pulled, the apparatus will double-label.

Once the leading edge of the label L adheres itself to the article, the apparatus will perpetuate the process from the rolling action of the article on the rollers 40, 46. The rolling article pulls the label roll, thus turning it, and the label roll will pull the empty liner and the rolling detachment roller 40 advances the waste substrate out the front the apparatus.

The brakes 58 prevent double labeling and should be adjusted to provide adjust as little friction as possible. If double-labeling is occurring, the brakes may be tightened to slow the rate at which labels are dispensed. A light or empty article requires less braking than a full or heavy container, because a heavier container will create more friction with the friction sleeve 45 and thus quickly advance the substrate.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents.

What is claimed is:

1. An apparatus for dispensing a label from a roll of label-bearing substrate and for applying the label to an article, said apparatus comprising:

a frame comprising separated side panels;

a feed reel mounted between said side panels and upon which the roll may be removably disposed;

a label detachment roller, mounted between said side panels, for partially supporting the article; and a separator plate disposed between said side panels and having a front edge generally parallel and proximate to said detachment roller;

wherein substrate paid out from the spool is wrappable around said front edge thereby to induce detachment of the label from the substrate and application of the label to the article supported in part by the detachment roller.

2. An apparatus according to claim 1 further comprising means for adjusting the distance between said side panels.

3. An apparatus according to claim 2 wherein said means for adjusting comprises a threaded rod screwably engaged with said side panels.

4. An apparatus according to claim 1 further comprising a pair of collars upon said feed reel for containing the label roll, said collars selectively positionable axially along said feed reel to position the label in relation to the article.

5. An apparatus according to claim 1 wherein said feed reel is removably disposable upon said side panels, said side panels defining slots for receiving a shaft of said feed reel.

6. An apparatus according to claim 1 further comprising a brake assembly for selectively controlling the rotation of said feed roller.

7. An apparatus according to claim 6 wherein said brake assembly comprises:

a brake arm pivotally mounted to one of said side panels;

a brake spring for biasing said arm into frictional contact with said feed roller; and a brake adjustment screw for adjusting the bias force of said brake spring.

8. An apparatus according to claim 1 wherein said separator plate is selectively movable to adjust the distance between said front edge and said detachment roller to optimize detachment of the label and application of the label to the article.

9. An apparatus according to claim 1 further comprising a seating roller mounted between said side panels forward on said frame from, and parallel to, said label detachment roller, for partially supporting the article, wherein rotation of the article induces simultaneous rotary motion in said detachment roller and said seating roller.

10. An apparatus according to claim 9 wherein said side frame panels define a plurality of opposing slots for selectively receiving a shaft on said seating roller, wherein the distance of said seating roller from said detachment roller is adjustable.

11. An apparatus according to claim 9 further comprising at least one end ring disposed upon said seating roller.

12. An apparatus according to claim 11 wherein said at least one end ring is selectively movable axially along said seating roller to position said at least on end ring adjacent to an end of the article.

13. An apparatus according to claim 1 further comprising a friction sleeve disposed upon said label detachment roller.

14. An apparatus according to claim 13 wherein said friction sleeve comprises a fabric.

15. An apparatus according to claim 1 wherein said side panels define at least a pair of slots for removably receiving a shaft on said label detachment roller.

16. An apparatus according to claim 1 further comprising at least one guide roller disposed between said side panels.

17. An apparatus according to claim 16 further comprising at least one guide ring, movable axially upon said at least one guide roller, for guiding movement of the substrate.

18. An apparatus according to claim 1 wherein the article can be flipped 180 degrees in relation to said label detachment roller to accommodate a left edge leading or a right edge leading label.

19. An apparatus according to claim 1 wherein application of the label leaves remaining a waste substrate, and the waste substrate is rewound upon said feed reel.

20. An apparatus for dispensing a label from a roll of label-bearing substrate and for applying the label to an article, said apparatus comprising:

a frame comprising separated side panels;

a feed reel mounted between said side panels and upon which the roll may be removably disposed;

a label detachment roller, mounted between said side panels, for partially supporting the article; and a separator plate disposed between said side panels and having a front edge generally parallel and proximate to said detachment roller;

wherein application of the label leaves remaining a waste substrate, and the waste substrate is disposed between the article and said detachment roller and rewound upon said feed reel, and substrate paid out from the spool is wrappable around said front edge thereby to induce detachment of the label from the substrate and application of the label to the article supported in part by the detachment roller, and further wherein rolling motion of the article imparts rolling motion in said detachment roller, thereby pulling on the substrate thereby to unwind substrate from the roll.

* * * * *